United States Patent [19]

Hoffer et al.

[11] Patent Number: 4,816,033

[45] Date of Patent: Mar. 28, 1989

[54] METHOD FOR ALTERING FABRIC FINISHES

[75] Inventors: Jerry M. Hoffer; Mitchell R. Brasington; L. Paul Berry, all of El Paso, Tex.

[73] Assignee: East-West Apparel, Inc., El Paso, Tex.

[21] Appl. No.: 189,341

[22] Filed: May 2, 1988

[51] Int. Cl.[4] ..... D06F 21/04; B05D 7/24

[52] U.S. Cl. ..... 8/158; 8/159; 427/242; 427/243; 427/294

[58] Field of Search ..... 8/147, 150, 158, 159, 8/102, 137; 427/242, 243, 294; 68/13 R, 29, 30, 142; 69/23, 28, 30; 26/19, 28; 51/313, 316

[56] References Cited

U.S. PATENT DOCUMENTS 4,304,562 12/1981 Bolan et al. ..... 427/423 X
4,575,887 3/1986 Viramontes ..... 8/159 X
4,750,227 6/1988 Hopkins et al. ..... 8/159 X

FOREIGN PATENT DOCUMENTS 3129699 2/1983 Fed. Rep. of Germany ..... 68/13 R

*Primary Examiner*—Philip R. Coe
*Attorney, Agent, or Firm*—Browning, Bushman, Zamecki & Anderson

[57] ABSTRACT

Improved techniques are provided for giving new garments, such as jeans, a worn appearance by tumbling the garments with potassium permanganate impregnated pumice rock. Pumice rock is thoroughly and quickly impregnated with potassium permanganate solution by placing the rock in a sealed chamber, drawing a vacuum in the chamber, spraying a potassium permanganate solution into the chamber while allowing the vacuum to drop to a preselected level, then retrieving the impregnated rock from the chamber. The garments and impregnated rock are then tumbled in a perforated container. New garments are added with additional rock to replenish the reduced the reduced volume of the used rock, which need not be reimpregnated. A preferred stone-washed appearance may be obtained by the combined bleaching effect of the potassium permanganate and the abrasive action of the rock.

20 Claims, 1 Drawing Sheet

METHOD FOR ALTERING FABRIC FINISHES

BACKGROUND OF THE INVENTION

1. Field of the Invention

The present invention relates to methods and apparatus for bleaching clothes and, more particularly, relates to techniques for "stone-washing" clothes using pumice rock impregnated with potassium permanganate.

2. Description of the Background

Stone-washing of garments has become increasingly popular in the past decade. This process generally consists of exposing the garments, such as jeans, to a combination of bleaching and an abrasive material, so that the jeans become both faded and appear to have been worn. The worn appearance desired by stone-washing may be obtained by (1) tumbling the garments with an abrasive stone, metal, or plastic material in a "dry" process, (2) tumbling the garments in a washing machine wherein the internal walls of a washing machine cylinder have been previously abraded by a volcanic rock, (3) washing the garments in water containing pumice rock, as generally described in German specification No. DE129699, or (4) agitating the garments in water and pumice sand, as disclosed in U.S. Pat. No. 4,575,887.

With respect to the first technique described above, the desired stone-washed appearance can be obtained by impregnating the pumice rock with potassium permanganate or other bleaching solutions. Pumice rock is an ideal abrasive material for achieving the desired worn appearance for the garments, and impregnated pumice rock allows the bleaching and abrasive functions to co-act with very favorable results. One of the significant problems with the pumice rock tumbling technique, however, relates to the difficulty of getting the bleaching solution to completely impregnate the pumice rock. Pumice rock is generally lighter than the potassium permanganate solution, and thus floats on the solution. Pumice rock has heretofore been placed in perforated buckets and forced down into a potassium permanganate solution, so that the solution impregnates the outer layer of pumice rock. The rock with the impregnated outer layer is then tumbled with the garments as described above in the stone-washing process. After the batch of garments has been tumbled, the garments are typically separated from the reduced diameter rock, which typically has its outer layer worn off by the abrasive tumbling action. A new outer layer of the rock is then generally reimpregnated and the rock reused in another batch process, until the rock or stones are reduced to an impractically small size, at which time the stones are discarded.

The impregnation of wood with preservatives or fire retardant liquids has long been accomplished by immersing the wood in liquid, then applying pressure to the liquid to drive the liquid into the wood, as disclosed in U.S Pat. Nos. 3,671,299 and 3,460,979. U.S. Pat. No. 4,433,031 discloses a special polymer for impregnating wood, wherein the wood is placed in a sealed chamber, a vacuum of at least twenty-six inches of mercury is drawn on the container, the wood is immersed in liquid while still under a reduced pressure, and pressure is increased to a level of about 350 psi to drive the liquid into the wood. Others have suggested the use of wave energy (U.S. Pat. No. 3,551,190) and sonic vibration (U.S. Pat. No. 3,639,152) to assist in impregnation of wood with a liquid preservative.

Metal castings intended to be subjected to pressure have long been impregnated with resins to seal porosity and prevent leakage. In many instances, the impregnation of metal castings seeks to seal the exposed surfaces of the castings rather than to impregnate the entire casting. The casting may be immersed in liquid and a vacuum then drawn on the chamber holding the castings (wet vacuum), or the vacuum may be first drawn on the chamber in which the castings are placed and liquid added (dry vacuum). In either case, the vacuum is released to achieve the effect of driving the resin into the outer skin layer of the casting. According to the disclosures of U.S. Pat. Nos. 4,311,735 and 4,384,014, pressure is subsequently applied to the chamber to assist in driving the liquid into the castings. A centrifuge for recovering excess impregnating liquid is disclosed in U.S. Pat. No. 4,196,231, and a special pressure vessel with porous support members is disclosed in U.S. Pat. No. 4,620,991.

An application roller for pressing an impregnating material into stone plates to seal the plates is disclosed in U.S. Pat. No. 4,620,989. U.S. Pat. No. 4,013,809 discloses a technique for sealing porous block, wherein the block is placed in a liquid-tight flexible bag which is then subjected to a vacuum, and a resin fed into the bag to immerse the block. A continous process for removing air from fruits and vegetables is disclosed in U.S. Pat. No. 3,052,209.

Although several porous objects, principally wood and metal castings, have long been impregnated with liquids with the assistance of vacuum, those skilled in the art of bleaching clothes and stone-washing fabrics have heretofore not recognized the applicability of technology associated with impregnating porous objects for stone-washing and, particularly, for impregnating pumice rock with a bleaching solution. Moreover, the characteristics of pumice rock and the purpose served by using pumice rock impregnated with a bleaching liquid as an integral step of a fabric bleaching process have historically been considered distinct from the characteristics of wood or castings and the techniques associated with impregnating those objects to retard decay and/or seal the object's surface.

The disadvantages of the prior art are, however, overcome by the present invention, and improved methods and apparatus are hereinafter disclosed for giving garments a worn and bleached or "stone-washed" appearance utilizing pumice rock impregnated to its core with a selected bleaching solution, such as potassium permanganate.

SUMMARY OF THE INVENTION

According to the preferred technique of the present invention, pumice rock is placed in a vessel and washed with water to remove fines and clay minerals. The vessel is then sealed and a vacuum drawn to approximately twenty inches of mercury. With the vacuum pump off, potassium premanganate is sprayed into the vessel. As potassium premanganate is sprayed into the evacuated vessel, the pressure will fall due to the input of liquid to the vessel and the release of air from the pumice rock. The spraying operation is continued until the vacuum drops a preselected level, typically from zero to three inches of mercury, at which time the spraying is discontinued. The pumice rock, if fully impregnated with potassium permanganate, will typically sink in the liquid bath. If the pumice is not fully impregnated, the process is repeated. Once the pumice is fully impregnated, the liquid is then drained from the vessel for reuse, and the impregnated rock tumbled with the garments in a perforated drum. The garments are then removed from the drum and placed in a sodium bisulfite solution to neutralize the potassium permangante, are subsequently washed in water, and finally dried. During tumbling, small fragments of grains from the pumice rock pass through the perforations of the drum and are discarded. After several tumbling operations, additional potassium permanganate is added to the tumbler.

It is an object of the present invention to provide an improved technique for stone-washing garments using pumice rock or a similar porous abrasive material which is entirely impregnated with a bleaching liquid.

It is another object of the invention to provide a low-cost rapid technique for impregnating pumice rock with a bleaching liquid until the entirety of the rock is permeated.

It is another feature of the invention to provide an improved technique for impregnating pumice rock with potassium permanganate which minimizes the handling of concentrated potassium permanganate by operators.

A feature of the present invention utilizes a sprayed liquid in a vacuum chamber to impregnate pumice rock.

It is an advantage of the present invention that the pumic rock may be reused for tumbling with garments for repeated stone-washing operations without the rock having to be reimpregnated with a bleaching solution.

The techniques of the present invention are well adapted for achieving quality stone-washing of garments without requiring a great deal of labor and without utilizing expensive equipment. The techniques of the present invention are well adapted to large-scale commercial stone-washing operations.

These and further objects, features, and advantages of the present invention will become apparent from the following detailed description, wherein reference is made to the Figures in the accompanying drawings.

DETAILED DESCRIPTION OF THE PREFERRED EMBODIMENTS

The technique of the present invention allows garments to be more economically stone-washed. The invention is particularly applicable to the commercial treatment of new garments in a batch process. Typically one-thousand garments or more may be delivered by a garment manufacturer to a facility for stone-washing, and the garments batch-treated according the the present invention in lot sizes depending upon the size of the tumbler. The stone-washed garments are typically returned to the manufacturer for wholesale shipment to retailers. "Blue jeans" are one of the more popular stone-washed garments, although the invention is applicable to other garments and wearing apparel, including jackets, shirts, dresses, cloth shoes, etc.

Figure 1:
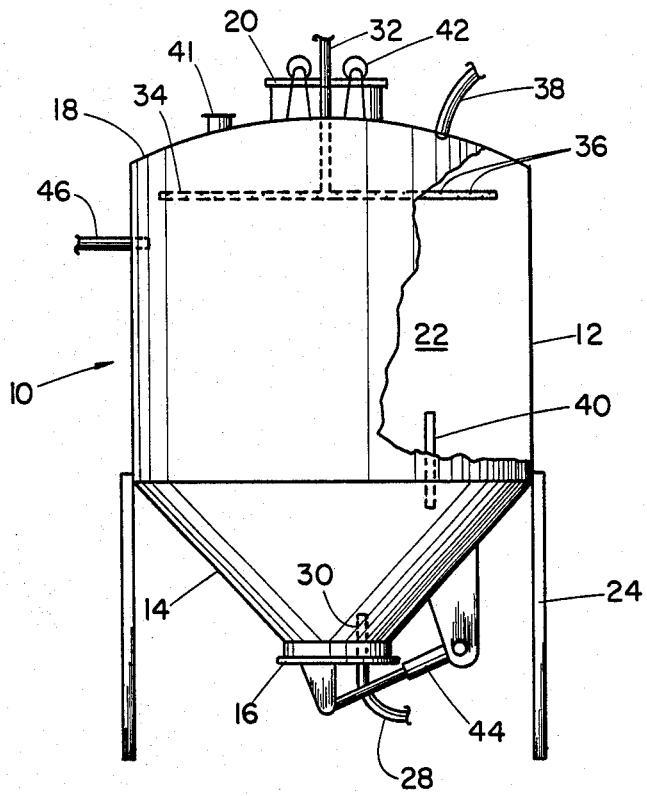
FIG. 1 is a pictorial view, partially in cross-section, of a suitable vessel for impregnating pumice rock according to the present invention.

Referring first to FIG. 1, there is shown a suitable vessel 10 for impregnating pumice rock with potassium permanganate or other selected liquid bleach. The vessel preferably includes a generally cylindrical upper body 12, a frustoconical lower body 14 having a discharge door 16 at a lower end thereof, a convex cover 18, and a top access door 20. With the doors, 16, 20 closed, a sealed cavity 22 is thereby formed within the vessel. A suitable transport cart (not shown) is intended to be positioned below the door 16 to receive impregnated pumic rock, and accordingly the vessel 10 is suitably supported on a plurality of conventional legs 24.

A drain line 28 with a filter cartridge 30 at the end thereof is provided for draining liquid from the vessel. Liquid is input to the vessel by a spray line 32 having a ring-shaped spray header 34 at the end thereof. Header 34 is preferably provided in the upper portion of the chamber 22, and includes a plurality of small diameter perforations 36 uniformly arranged about the circumference of the header, with some of the perforations being directed downward, some perforations being directed horizontally, and some perforations being directed at a downwardly inclined angle. A vacuum line 38 from the vessel is provided for withdrawing gas from the chamber 22 to create a vacuum within the vessel. A conventional sight glass 40 is provided for operator viewing of the liquid level in the vessel. If desired, a glass 41 may be provided in the convex cover 18 for operator viewing of the chamber 22 while under vacuum.

The top hinge door 20 may be power opened or closed by a plurality of fluid cylinders 42. The door 20 may be opened to input pumice rock into the vessel, and when closed, seals the vessel to create a fluid-tight chamber. Similarly, the discharge door 16 is pivotally provided for dumping impregnated pumice rock from the vessel to a transport buggy (not shown). The door 16 is powered by a plurality of cylinders 44, and seals with the vessel when closed. The angle of the frustoconical walls for the lower section 14 is preferably 45° or more from the horizontal, so that all pumice rock will slide out of the vessel when door 16 is fully open.

Figure 2:
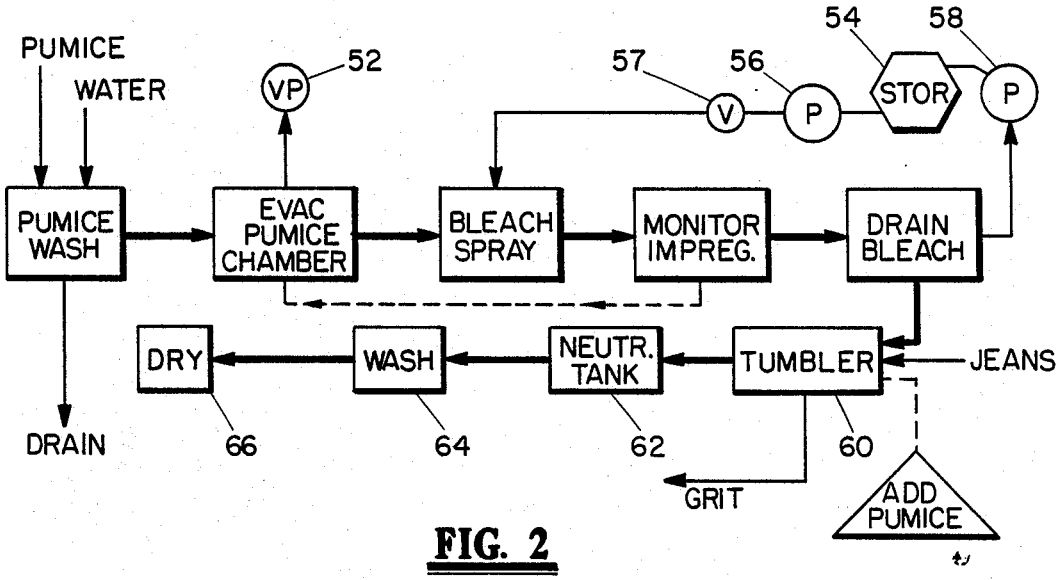
FIG. 2 is a flow block diagram of the method according to the present invention.

According to a preferred technique of the present invention and referring to FIGS. 1 and 2, pumice rock generally having a mean diameter in the range of from two to four inches is dumped through the opened door 20 into the vessel 10 to fill the lower conical section 14 and a portion of the cylindrical section 12. Water is then pumped into the vessel through line 46 and the pumice rock is washed to remove loose grit, clay, and sediment which might otherwise adversely effect the desired bleaching or abrasive action during the subsequent tumbling operation. The water may be discharged through line 28 and passed to a suitable drain.

Once the water from the discharge 28 is clear, a vacuum pump 52 is turned on to evacuate the chamber 22 to a selected level, generally in the range of from 18 to 22 inches of mercury. Potassium permanganate solution from storage tank 54 is then sprayed into vessel 10 by pump 56 through line 32. One-hundred gallons of solution may typically be input to the vessel holding approximately 300 to 600 pounds of pumice rock.

According to the present invention, all the pumice rock is preferably fully impregnated by the effect of spraying into an evacuated chamber which houses the rock, so that none of the rock need be thereafter reimpregnated after one or more tumbling operations. Accordingly, liquid potassium permanganate is sprayed into the evacuated upper portion of the chamber 22 with the vacuum pump off. Approximately one-hundred gallons of liquid potassium permanganate may be sprayed into the vessel during a time period of approximately ten minutes. Some of the sprayed liquid will vaporize due to the low pressure in the sealed vessel, air near the core of the pumice rock will be released and replaced with potassium permanganate, and accordingly air will be released from the pumice rock, and the released air and input of liquid to the sealed chamber will cause the vacuum to slowly drop. As the pumice rock becomes fully impregnated, it will sink in the excess (nonpermeating) liquid potassium permanganate bath.

After a desired quantity of sprayed liquid has been added and the vacuum in the sealed chamber reaches a predetermined level, e.g., 5 inches of mercury, the pump 56 may be shut off and the vessel left alone until the vacuum drops to a lower selected level, generally in the range of from 1 to 3 inches of mercury. During the waiting period, additional potassium permanganate may enter the rock above the liquid surface, and the impregnated rock will then sink. If the rock does not sink in a short period of time, the excess liquid may be retained in the tank, the vacuum again created, and the spray process again initiated until all the rock is fully impregnated and sinks in the liquid. Tests show that the center of the pumice rock becomes fully impregnated with potassium permanganate using the technique of the present invention.

In many instances, most of all of the rock will become full impregnated and thus sink in the liquid bath after one spraying operation. The techniques of the present invention are particularly suited to the rapid impregnation of pumice rock desired for commercial stone-washing operation. Accordingly, the tank may be immediately opened to atmosphere after the first spraying operation. If all the rock has not been fully impregnated (as observed by being 1–5 mersed in the liquid bath), the door 20 may be closed, a vacuum of approximately 20 inches of mercury drawn in the chamber 22, and the spraying process reinitiated. In almost all cases the entirety of the pumice rock can be easily and quickly fully impregnated by two such vacuum/spraying operations.

Once the rock has been fully impregnated, vent line 38 may be opened to allow air to enter the vessel and bring the pressure back to the atmospheric level. Drain line 28 may then be opened to drain liquid from the tank, and pump 58 may be activated to pump the drained liquid back to the storage tank 54 for subsequent reuse or, if desired, to a waste storage tank. The cylinder 44 may then be activated to open discharge door 16 and drop the impregnated rock to a transport cart. A quantity of new blue jeans, typically approximately 100 pair, may be placed in a conventional tumbler 60 having a perforated drum with approximately two-hundred pounds of impregnated pumice rock. The jeans and rock may then be tumbled for a short time period of from four to eight minutes, and the jeans removed from the tumbler and immediately placed in a neutralizing tank 62 containing, for instance, a liquid sodium bisulfite solution. Sodium bisulfite neutralizes the bleaching effect from the potassium permanganate, thereby inhibiting undesired additional deterioration of the fabric.

After being neutralized, the jeans may be placed in a conventional washer 64 and washed with water and a detergent to remove any remaining grit and chemicals. After being sufficiently washed, the jeans may be sent to dryer 66 for conventional drying, then folded and packaged for shipment back to the manufacturer.

During the tumbling operation, the pumice rock will abrade against the jeans, thereby giving the jeans the desired "worn" look, while the potassium permanganate within the pumice rock is slowly released during this abrasive process to perform its desired bleaching effect on the jeans. This tumbling action will cause the exterior layer of each pumice rock to become worn away so that the rock will decrease in size. Nevertheless, since the rock has been fully impregnated with potassium permanganate, the new layer continues to contain the desired quantity of liquid bleach to achieve its intended effect. During the tumbling operation, most of the grit or sand worn off the pumice rock will pass through perforations in the tumbler, and may be discharged from the bottom of the tumbler and discarded.

A given quantity of pumice rock may typically be used for tumbling several "loads" of jeans. After a period of time, additional pumice rock may be added to the tumbler with a new batch of jeans. As a feature of the present invention, however, the "used" pumice rock need not be reimpregnated, and may be continually reused until its size is sufficient to allow it to pass through the perforations in the tumbler. If desired, the used pumice rock may be dumped from the tumbler 60 and weighed so that a known weight of pumice rock may be provided for a new batch of jeans.

A suitable drain pump 58 is a Dayton Model 1P835 $1\frac{1}{2}$ HP centrifugal pump with a $1\frac{1}{4}''$ inlet and a 1" outlet. A suitable spray pump 56 is a Dayton Model 1P833 $\frac{3}{4}$ HP centrifugal pump with a 1" inlet and a $\frac{3}{4}$ outlet. A suitable vacuum pump 52 is a Dayton Model 4ZH70 $1\frac{1}{2}$ HP vacuum pump.

Several modifications of the technique described above will be suggested by the above disclosure. The rock may be put in the tumbler, a vacuum drawn on the tumbler, and the liquid input such that the liquid cascades slowly over the pumice rock. Also, it may be possible in input a relatively small quanitity of pumice rock to a liquid bath with a vacuum above the bath, allowing the layer of floating pumice rock to become impregnated and thus sink, and then input another quantity of rock. This latter procedure would, however, be time consuming and thus expensive compared to the preferred spraying technique. Alternatively, (although again less desirably) the rock could be repeatedly raised and lowered above and below the level of a liquid potassium permanganate bath, or the liquid level could be repeatedly raised or lowered with respect to the rock, such that each rock is repeatedly subjected to the liquid-/air (vacuum) interface.

According to the present invention, liquid is input to a chamber which houses the pumice rock and is under a vacuum. The liquid is input in such a manner that each rock is continually and/or repeatedly subjected to both the simultaneous vacuum and to the liquid. In this manner, the liquid potassium permanganate penetrates the rock in a much more rapid manner and to a much deeper extent than if the rock were fully submerged in a liquid bath. The rock, once fully impregnated, will tend to sink in the liquid bath, and this provides an easy technique for determining if the rock is fully impregnated, or if the vaccum/spray process should be repeated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A method of altering fabric finishes on garments to create a stone-washed appearance, comprising:

(a) placing pumice rock in a chamber;

(b) sealing and evacuating the chamber to obtain a vacuum of a first selected level about the pumice rock;

(c) spraying a selected bleaching solution into an evacuated portion of the sealed chamber while maintaining the chamber sealed until vacuum drops to a selected second level;

(d) opening the chamber to atmosphere when the pumice rock has been fully impregnated with the selected bleaching solution;

(e) draining excess bleaching solution from the vessel;

(f) tumbling the impregnated pumice rock with a selected quantity of garments to bleach the garments and simultaneously abrade the garments with the pumice rock;

(g) placing the tumbled garments in a neutralizing liquid to counteract the bleaching solution; and (h) washing the neutralized garments in water.

2. The method as defined in claim 1, further comprising:

re-evacuating the chamber to create a vacuum substantially higher than the second level subsequent to terminating step (c); and thereafter re-spraying additional bleaching solution into the re-evacuated portion of the sealed chamber.

3. The method as defined in claim 1, wherein the impregnated pumice rock and garments are tumbled in a perforated container, such that grit worn from the pumice rock will pass through the container while tumbling the pumice rock and garments.

4. The method as defined in claim 1, further comprising:

adding additional pumice rock to the tumbled pumice rock to obtain a preselected quantity of impregnated pumice rock; and tumbling another selected quantity of garments in the preselected quantity of impregnated pumice rock.

5. The method as defined in claim 1, further comprising:

washing the pumice rock in the chamber with water prior to performing step (b).

6. The method as defined in claim 1, wherein the first selected level of vacuum is between 18 to 22 inches of mercury.

7. The method as defined in claim 1, wherein pumice rock is selected having a mean diameter in the range of from 2 to 4 inches.

8. The method as defined in claim 1, wherein the selected bleaching solution is potassium permanganate.

9. The method as defined in claim 8, wherein the neutralizing liquid is sodium bisulfite.

10. A method of altering fabric finishes on garments to create a stone-washed appearance, comprising:

(a) placing pumic rock in a chamber;

(b) sealing and evacuating the chamber to obtain a vacuum of from 18 to 22 inches of mercury about the pumice rock;

(c) inputting a bleaching solution into an evacuated portion of the sealed chamber above a bleaching solution liquid level while maintaining the chamber sealed until the vacuum drops to a level of from 0 to 5 inches of mercury;

(d) opening the chamber to atmosphere when the pumice rock has been fully impregnated with the selected bleaching solution;

(e) draining excess bleaching solution from the vessel;

(f) tumbling the pumice rock with a selected quantity of garments to bleach the garments and simultaneously abrade the garments with the pumice rock, while simultaneously allowing the grit worn off the pumice rock to pass through perforations in the container; and (g) placing the tumbled garments in a neutralizing liquid.

11. The method as defined in claim 10, further comprising:

adding additional pumice rock to the tumbled pumice rock to obtain a preselected quantity of impregnated pumice rock; and tumbling another selected quantity of garments in the preselected quantity of impregnated pumice rock.

12. The method as defined in claim 10, further comprising:

washing the pumice rock in the chamber with water prior to performing step (b).

13. The method as defined in claim 10, wherein the selected bleaching solution is potassium permangante, and the neutralizing liquid is sodium bisulfite.

14. The method as defined in claim 10, wherein pumice rock is selected having a mean diameter in the range of from 2 to 4 inches.

15. A method of impregnating pumice rock with a selected bleaching solution for stone-washing garments by tumbling the impregnated pumice rock and garments, the method comprising:

placing pumice rock in a chamber;

sealing the chamber;

evacuating the sealed chamber to obtain a vacuum of a first selected level about the pumice rock;

inputting the bleaching solution into the evacuated sealed chamber while maintaining the chamber sealed, such that individual pumice rock is simultaneously subjected to vacuum and bleaching solution, until the vacuum in the sealed chamber drops to a second selected level;

opening the chamber to atmosphere when the pumice rock has been fully impregnated with the selected bleaching solution; and draining excess bleaching solution from the vessel.

16. The method as defined in claim 15 further comprising:

re-evacuating the chamber to create a vacuum substantially higher than the second level subsequent to terminating the input of bleaching solution into the re-evacutated sealed chamber; and thereafter re-inputting additional bleaching solution into the re-evacuated portion of the sealed chamber.

17. The method as defined in claim 15, further comprising:

washing the pumice rock with water prior to sealing the chamber.

18. The method as defined in claim 15, wherein the first selected level of vacuum is between 18 to 22 inches of mercury.

19. The method as defined in claim 1, wherein the pumice rock to be placed in the chamber is selected having a mean diameter in the range of from 2 to 4 inches.

20. The method as defined in claim 15, wherein the bleaching solution is potassium permanganate.

* * * * *